US007823524B2

(12) United States Patent
Van Cann et al.

(10) Patent No.: US 7,823,524 B2
(45) Date of Patent: Nov. 2, 2010

(54) CONSTRUCTION OF FPDSO VESSEL

(75) Inventors: Bram Van Cann, Nice (FR); Leendert Poldervaart, Monaco (MC)

(73) Assignee: Single Buoy Moorings, Inc. (CH)

( * ) Notice: Subject to any disclaimer, the term of this patent is extended or adjusted under 35 U.S.C. 154(b) by 26 days.

(21) Appl. No.: 12/368,233

(22) Filed: Feb. 9, 2009

(65) Prior Publication Data

US 2009/0217861 A1 Sep. 3, 2009

Related U.S. Application Data

(60) Provisional application No. 61/066,610, filed on Feb. 20, 2008.

(51) Int. Cl.
*B63B 3/04* (2006.01)

(52) U.S. Cl. ..... 114/77 A; 114/356

(58) Field of Classification Search ..... 114/65 R, 114/74 R, 77 A, 77 R, 356
See application file for complete search history.

(56) References Cited

U.S. PATENT DOCUMENTS 3,527,185 A 9/1970 Yamada et al.
3,675,606 A * 7/1972 Takezawa et al. ..... 114/65 R
3,742,889 A * 7/1973 Weise et al. ..... 114/65 R
3,834,174 A * 9/1974 Strumbos ..... 114/74 A
4,341,175 A 7/1982 Ivanov
5,090,346 A * 2/1992 Goldman ..... 114/77 R
5,320,056 A 6/1994 Marizoli
5,325,805 A * 7/1994 Howson ..... 114/77 A
6,048,135 A 4/2000 Williford et al.
6,968,795 B2 11/2005 Lambregts et al.
7,669,541 B2 * 3/2010 Horton et al. ..... 114/77 R

FOREIGN PATENT DOCUMENTS

FR 916815 A 12/1946

* cited by examiner

*Primary Examiner*—Lars A Olson
(74) *Attorney, Agent, or Firm*—Leon D. Rosen

(57) ABSTRACT

A vessel with drilling and workover capability is constructed rapidly in a shipyard or dry dock by using an existing vessel that has most of the required hull. Bow and stern sections of the existing vessel are separated to leave them at opposite ends of a shipyard space, and a mid hull section is built in that shipyard space in the usual manner by welding together steel plates. The bow and stern sections are moved against opposite ends of the mid hull section and welded to it. Topside equipment is already on the bow and stern sections, and is added to the new mid hull section.

4 Claims, 3 Drawing Sheets

CONSTRUCTION OF FPDSO VESSEL

CROSS-REFERENCE

Applicant claims priority from U.S. provisional patent application Ser. No. 61/066,610 filed 20 Feb. 2008.

BACKGROUND OF THE INVENTION

One type of vessel used in hydrocarbon production is an FPSO (floating, production, storage and offloading) vessel, which is of moderate size and widely available. Another type which is larger and not readily available, is an FPDSO (floating, production, storage, drilling, and offloading) vessel. The FPDSO vessel has complex drilling and workover equipment in its middle which usually allows the vessel to weathervane during drilling, production and offloading operations.

Shipyards have dry docks with "time slots" (continuous time periods) reserved for construction of a vessel. The required length of the time slot depends primarily on the amount of steel plate that must be welded together to produce a hull of a desired vessel. There are only a few shipyards available in the world that are capable of building very large vessels such an FPDSO, and it is often difficult to find a yard with a sufficiently long available time slot. A method for constructing a FPDSO which greatly reduced the required length of a shipyard time slot for such construction, would be of value.

SUMMARY OF THE INVENTION

In accordance with one embodiment of the invention, a method is provided for the construction of a very large vessel such as an FPDSO, using only a short time slot in a large shipyard. Applicant first obtains an existing, or initial, FPSO (floating, production, storage and offloading) vessel and sails it into a shipyard. Applicant then divides the FPSO hull into bow and stern sections and separates them to leave a yard space between them. Applicant then constructs a mid hull section in the yard space. The mid hull section usually provides drilling and workover capability as well as providing a turret for weathervaning capability. When mid hull section construction is finished, the bow and stern sections are moved against the front and rear ends of the mid hull section and welded to it. Most equipment for the bow and stern ends is usually already mounted on them. Equipment for the mid hull section is usually prefabricated so it can be rapidly mounted on the mid hull section, in the shipyard or at a harbor side or quay or dock.

Beams are preferably mounted on opposite sides of the FPDSO hull. The beams extend along the entire length of the mid hull section and along portions of the bow and stern hull sections. The beams strengthen the hull and account for the fact that the original bow and stern sections were constructed for a lighter vessel. The beams preferably extend along a majority of the height of the hull up to the deck, and add to the usable deck space.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
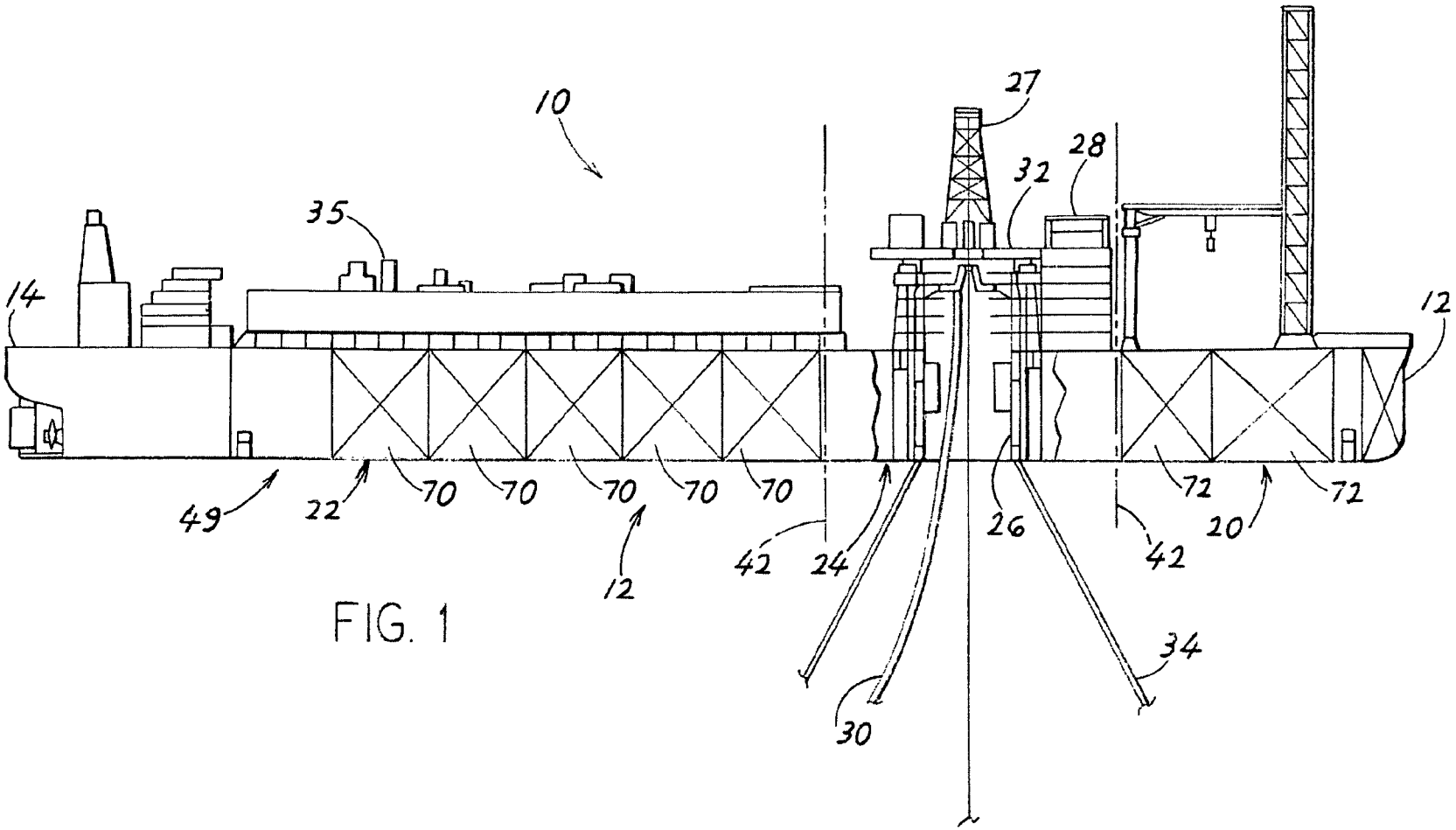
FIG. 1 is a sectional side view of a FPDSO vessel, constructed in accordance with the present invention.

FIG. 1 shows a FPDSO (floating, production, drilling, storage and offloading) vessel 10, which has bow and stern ends 12, 14, and which can be considered to have a bow hull section 20, a stern hull section 22, and a mid hull section 24. The mid hull section 24 is used to hold complex equipment for drilling undersea wells and for the workover of wells, and usually holds a turret 26 to allow the vessel to weathervane (turn without limit about a vertical axis), or the vessel is spread moored. FIG. 1 shows a drilling rig 27 and a pipe string storage locker 28, a riser 30, fluid swivel 32 and anchor lines 34, and an offloading facility 35.

Figure 2:
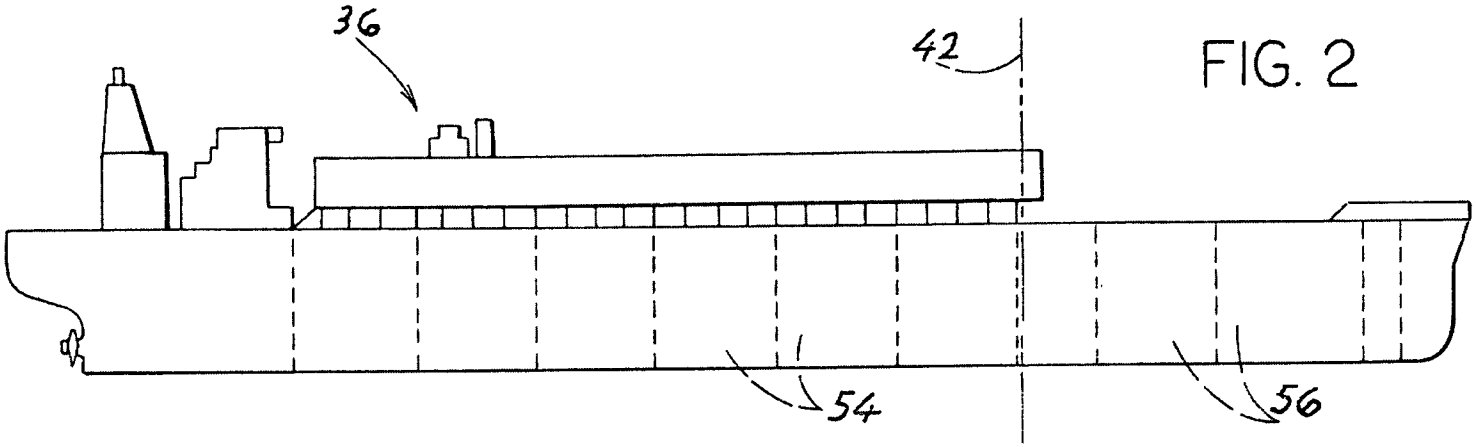
FIG. 2 is a simplified side elevation view of a FPSO vessel, from which applicant constructs the vessel of FIG. 1.

FIG. 2 shows a FPSO (floating, production, storage and offloading) vessel 36 which is similar to the vessel 10 except that it does not include the mid hull section 24 of FIG. 1 and the complex equipment on the mid hull section. The vessel has multiple tanks 54, 56 for storing produced oil (or other hydrocarbons). The simpler FPSO vessel 36 is available or can be built, but the more complex FPDSO vessels 10 are difficult to build because they require a large slot of time in a large shipyard. The amount of time to build a vessel depends primarily on the amount of steel plate that must be welded (inspected and ground, etc.) to produce the hull. There are only a few shipyard in the world large enough to hold the FPDSO and most of them do not have a long enough time slot available at any given time, to build one. The present invention comprises a method for building a large vessel such as a FPDSO 10, which requires only a short time slot in a large ship yard.

Figure 3:
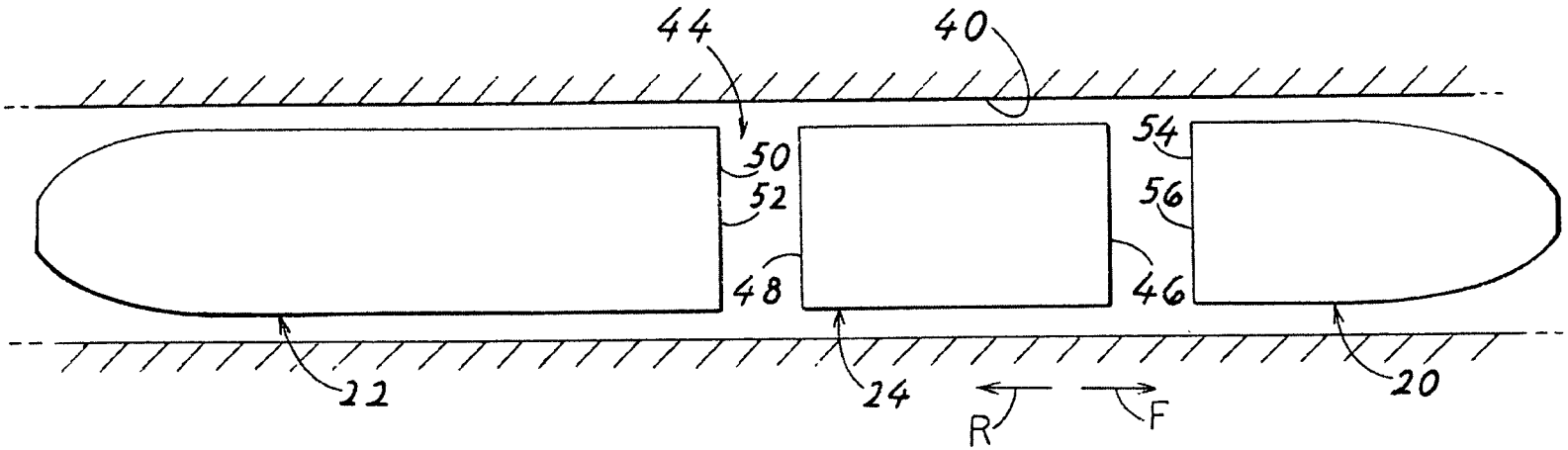
FIG. 3 is a simplified plan view showing how the vessel of FIG. 1 is constructed in a shipyard.

Applicant constructs the FPDSO 10 of FIG. 1 by starting with a smaller vessel such as a FPSO 36 such as shown in FIG. 2. The FPSO 36 is sailed into a large shipyard 40 (FIG. 3), and its bow and stern sections 20, 22 are spit or separated, such as along line 42 (FIG. 2). FIG. 3 shows the bow and stern section 20, 22 moved to opposite ends of the shipyard 40, to leave a yard space 44 between them. The mid hull section 24 is then built from "scratch" in the yard space, by welding together steel plates, until the mid hull section is completed.

Applicant welds steel plates 52 over the front end 50 of the stern section 22 and welds steel plates 54 over the rear end 56 of the bow section, to keep out water and to isolate the hydrocarbon tanks on the bow and stern ends from sparks produced by drilling and other equipment on the mid hull section. However, since the bow and stern sections 20, 22 do not have to sail out of the shipyard 40 before being joined to the mid hull section, the bow and stern sections do not have to be independently sea worthy. Then, the bow and stern hull sections 20, 22 are moved against the front 46 and rear 48 ends of the mid hull section and welded to the mid hull section to produce a tandem-connected hull 49 (FIG. 1). Topside equipment is installed, primarily on the mid hull section.

Figure 4:
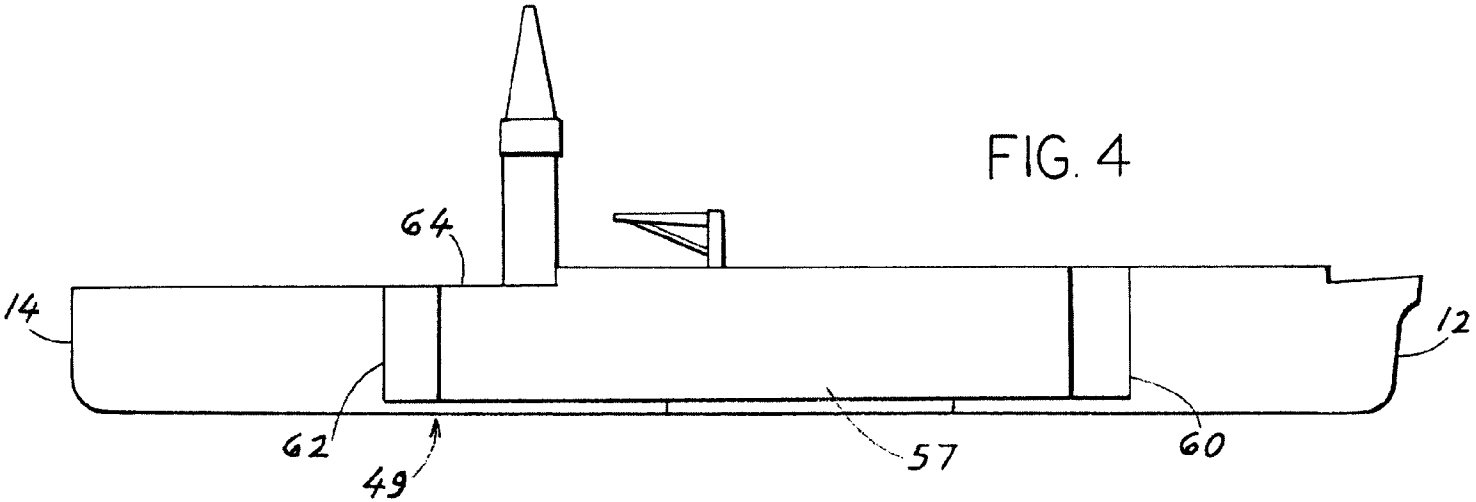
FIG. 4 is a side elevation view of a vessel similar to that of FIG. 1, but with side beams.
Figure 5:
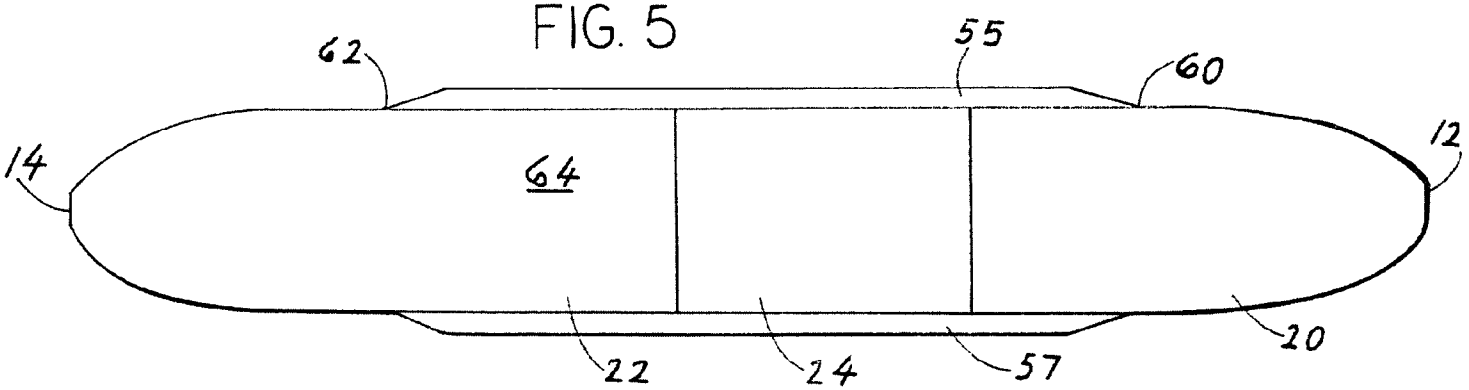
FIG. 5 is a simplified plan view of the vessel of FIG. 4.

The FPSO 36 (FIG. 2) which is converted to a FPDSO, was initially constructed to provide sufficient strength to withstand the weight and forces encountered by the FPSO, but not those encountered by the larger FPDSO. Applicant strengthens opposite sides of the hull of the FPDSO by welding beams, or sponsons, to opposite sides of the hull of the FPDSO. FIGS. 4 and 5 show a pair of beams 55, 57 at the port and starboard sides of the hull, and which extend along a majority of the height of the hull and that are each welded to all of the hull sections. Each beam has a length that is a majority of the length of the FPDSO between its ends 12, 14 with opposite beam ends 60, 62 that each lies a plurality of meters short of the closest hull end. To weld each beam to the bow or stern of the vessel generally would require properly bending the beam, which would be expensive and not necessary. Also, regions close to the bow and stern do not require reinforcement by such beams. The beams preferably extend along a majority, and preferably at least 80% of the height of the hull, and preferably extend up to the deck 64 of the FPDSO hull to provide additional deck space, as for drilling and workover equipment. The beams also enhance resistance to roll of the vessel, and essentially provide a partial double hull to avoid spillage of hydrocarbons.

In most cases the FPSO which is to be converted to a FPDSO, will be a plurality of years old. A brief examination of the FPDSO vessel will show that the bow and stern sections are a plurality of years older than the mid hull section, so the vessel was constructed in the manner described above.

The bow and stern sections each have a plurality of hydrocarbon storage tanks 70, 72 (FIG. 1), each having a volume of a plurality of cubic meters. Hydrocarbons produced from the sea floor are stored in these tanks and regularly offloaded to a carrier that takes them to a distant location. The mid hull section 24 does not store over a cubic meter of hydrocarbons and preferably does not store any hydrocarbons. This eliminates hydrocarbons on the mid hull section that could be ignited by sparks etc produced by the drilling/workover equipment on the mid hull section. The steel plates welded to the rear end of the bow hull section and to the front end of the bow hull section, provide further isolation of stored hydrocarbons from sparks.

Applicant has designed the conversion of a FPSO vessel 36 having a length of 260 meters and a width of 45 meters, into a FPDSO vessel having a length of 340 meters and a width of 53 meters (including the beams). It is expected that a time slot of at least 8 months would be required in a large ship yard to build the hull of such FPDSO. However, a time slot of only 4 months would be required to split an existing FPSO and weld plates over their ends, build a mid hull section, and weld the bow and stern hull sections to the mid hull section.

Thus, the invention provides a method for constructing a large vessel such as a FPDSO, which uses an existing, or initial, smaller vessel such as a FPSO which is similar to the FPDSO except for a mid hull section. The initial vessel is moved into a ship yard and is split into bow and stern hull sections, which are separated but remain in the ship yard. A mid hull section is constructed in the yard space between the bow and stern hull sections. The bow and stern hull sections are moved against the mid hull section and welded thereto. Where bow and/or stern hull sections have hydrocarbon-holding tanks, and the mid hull section is designed to contain drilling equipment, which produces sparks, a plate is preferably welded across the rear end of the bow hull section and across the front end of the stern hull section. Beams are preferably welded to opposite sides of the hull at all three of the sections, with the beams preferably extending up to the deck to enlarge deck space.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for constructing a vessel (10) with hydrocarbon production storage and offloading capability and with drilling capability for drilling and/or workover of subsea wells, comprising:

obtaining a FPSO (floating production storage and offloading) initial vessel (36) which has bow and stern hull sections (20, 22), placing said initial vessel in a shipyard (40), and dividing the hull of said initial vessel into said bow and stern hull sections and separating said bow and stern hull sections to leave a shipyard space (44) between them;

constructing a mid hull section (24) with front and rear ends (46, 48), in said shipyard space between said initial vessel bow and stern hull sections;

moving said initial vessel bow and stern hull sections respectively against said mid hull section front and rear ends and welding said bow and stern hull sections respectively to said mid hull section front and rear ends to produce a tandem-connected hull (49) containing said bow (20), mid (24) and stern (22) hull sections lying in tandem and welded together;

after producing said tandem-connected hull, placing beams (55, 57) that are longer than said mid hull section at opposite sides of said welded-together mid, bow, and stern hull sections and welding each of said beams to each of said hull sections.

2. The method described in claim 1 wherein:

said step of placing beams includes placing a beam (55) at the port side and a beam (57) at the starboard side of the tandem-connected hull, with each beam being welded to each hull section and extending along a majority of the height of each hull section.

3. A FPDSO (floating production, drilling, storage and offloading) vessel (10) comprising:

a bow hull section (20), a mid hull section (24) that holds equipment (27) for drilling undersea wells, and a stern hull section (22), said hull sections being connected in tandem by welds at front and rear ends of said mid hull section to form a FPDSO vessel hull (49);

a pair of beams (52, 57), each welded to an opposite side of the FPDSO vessel hull, each beam extending along at least 50% of the length of the FPDSO vessel and each welded to the mid, bow and stern hull sections.

4. The vessel described in claim 3 wherein:

each of said beams extends vertically along a majority of the height of the FPDSO vessel hull, and each beam has longitudinal opposite ends (60, 62) each lying a plurality of meters short of a corresponding bow and stern end (12, 14) of the FPDSO vessel.

* * * * *